US007686042B2

(12) United States Patent
Haimi

(10) Patent No.: US 7,686,042 B2
(45) Date of Patent: Mar. 30, 2010

(54) CONTENTS DISPENSING MECHANISM

(76) Inventor: Shlomo Haimi, 641/10 Balfore St., Or Akiva (IL)

( * ) Notice: Subject to any disclaimer, the term of this patent is extended or adjusted under 35 U.S.C. 154(b) by 726 days.

(21) Appl. No.: 11/236,598

(22) Filed: Sep. 28, 2005

(65) Prior Publication Data

US 2006/0037663 A1 Feb. 23, 2006

Related U.S. Application Data

(63) Continuation-in-part of application No. 10/725,007, filed on Dec. 2, 2003, now Pat. No. 6,973,945.

(51) Int. Cl.
*B65B 31/04* (2006.01)

(52) U.S. Cl. ..... 141/65; 222/368

(58) Field of Classification Search ..... 222/362, 222/363, 368; 141/65
See application file for complete search history.

(56) References Cited

U.S. PATENT DOCUMENTS

| | | | | |
|---|---|---|---|---|
| 853,658 | A * | 5/1907 | Terry | 222/306 |
| 2,104,332 | A * | 1/1938 | Rohde et al. | 222/363 |
| 3,782,608 | A * | 1/1974 | Schneider | 222/368 |
| 5,779,082 | A * | 7/1998 | Miramon | 220/212 |
| 5,944,212 | A * | 8/1999 | Chang | 220/212 |
| 6,973,945 | B2 * | 12/2005 | Haimi | 141/65 |

* cited by examiner

*Primary Examiner*—Gregory L Huson
*Assistant Examiner*—Jason K Niesz
(74) *Attorney, Agent, or Firm*—Mark M. Friedman

(57) ABSTRACT

The present invention is a contents-dispensing mechanism for removing contents from the container while maintaining the integrity of the vacuum state within the container.

2 Claims, 8 Drawing Sheets

CONTENTS DISPENSING MECHANISM

This application is a Continuation-In-Part of U.S. patent application Ser. No. 10/725,007, filed 2 Dec. 2003 now U.S. Pat. No. 6,973,945.

FIELD AND BACKGROUND OF THE INVENTION

The present invention relates to lids that create a vacuum within the container on which the lid is deployed and, in particular, it concerns a lid assembly with a dispensing mechanism for removing contents from the container while maintaining the integrity of the vacuum state within the container.

Several bottle cap devices are known that are configured for use in conjunction with a separate pump such that once the vacuum is created, the pump is disconnected from the cap. These devices suffer from the need to store the pump while not in use, and prevent loss of the pump during such storage. Further, some of the pump mechanisms for devices of this type are expensive electrical devices that are inappropriate for consumers with a small number of containers requiring vacuum sealing.

One attempt to provide a bottle cap with an integral vacuum pump is disclosed in U.S. Pat. No. 6,637,321 to Wang. Wang's cap includes a piston style pump, the cylinder of which is deployed inside of the container on which the cap is deployed. A handle is formed on the exposed end of the piston, and the pump is operated by a push-pull motion. One drawback to this style of pump is the length of piston stroke necessary for efficient pumping. Therefore, the cylinder extends relatively far into the container, or in the case of U.S. Pat. No. 5,535,900 to Huang, the pump extends above the bottle.

Further, the bottle caps mentioned above require removal of the cap in order to access to contents of the bottle. Nor do the devices of prior art include a vacuum indication mechanism or a filter for use with powered contents in the container.

There is therefore a need for a container lid assembly which creates and maintains a vacuum state within a container and provides a dispensing assembly that allows removal of contents from the container while at least partially maintaining the integrity of the vacuum state within the container.

SUMMARY OF THE INVENTION

The present invention is a lid assembly with a dispensing mechanism for removing contents from the container while at least partially maintaining the integrity of the vacuum state within the container.

According to the teachings of the present invention there is provided, a lid assembly for removing contents from a container in which a partial vacuum has been created while maintaining the vacuum in the container, the lid assembly comprising: (a) a seat-portion configured for attaching the lid assembly to the container; (b) a contents inlet configured in the seat-portion, the contents inlet opening into an interior volume of the container; (c) a contents outlet configured in the seat-portion, the contents outlet opening to an exterior atmosphere of the container; (d) a rotatable dispensing element deployed in the seat-portion; and (e) a contents receptacle configured in the dispensing element, the dispensing element rotatable such that the contents receptacle is alternately alignable with the contents inlet and the contents outlet; wherein the contents inlet and the contents outlet are spaced apart such that, as the contents receptacle alternates between the contents inlet and the contents outlet, the contents receptacle passes through a region in which fluid communication between the contents receptacle and one of the contents inlet and the contents outlet is fully interrupted before fluid communication is established with another of contents inlet and the contents outlet.

According to a further teaching of the present invention, the rotatable dispensing element is actuated by a rotatable shaft manipulated from an exterior of the seat-portion.

According to a further teaching of the present invention, the rotatable dispensing element is configured as a substantially spherical element.

There is also provided according to the teachings of the present invention, a lid assembly for removing contents while maintaining the vacuum, the lid assembly comprising: (a) a seat-portion configured for attaching the lid assembly to the container; (b) a container portion configured with a plurality of individual storage compartments; (c) a plurality of vacuum passageways extending from a central vacuum chamber so as to provide fluid communication between each of the individual storage compartments and a pump configuration; (d) a contents outlet configured in the seat-portion, such that one of the plurality of individual storage compartments is exposed in the contents outlet.

According to a further teaching of the present invention, the container portion is rotatable within the seat-portion so as to expose subsequent individual storage compartments within the contents outlet as the container portion is rotated.

According to a further teaching of the present invention, the plurality of vacuum passageways and the central vacuum chamber are configured in the seat-portion.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a lid assembly with a dispensing mechanism for removing contents from the container while at partially maintaining the integrity of the vacuum state within the container.

The principles and operation of a dispensing mechanism according to the present invention may be better understood with reference to the drawings and the accompanying description.

By way of introduction, the present invention is a container lid assembly that includes an integral vacuum pump so as to create at least a partial vacuum within the container. As used herein, the terms "vacuum" and "partial vacuum" are used interchangeably and are consider to be synonymous, referring to any state of partial vacuum up to and including a state of complete vacuum. Another feature of the present invention is a contents-dispensing mechanism for removing contents from the container while at least partially maintaining the integrity of the vacuum state within the container. That is, dispensing the contents with the minimal amount of vacuum lose as possible, and preferably close to no lose of vacuum. However, it will be understood that some vacuum lose may occur during the dispensing procees.

Figure 1:
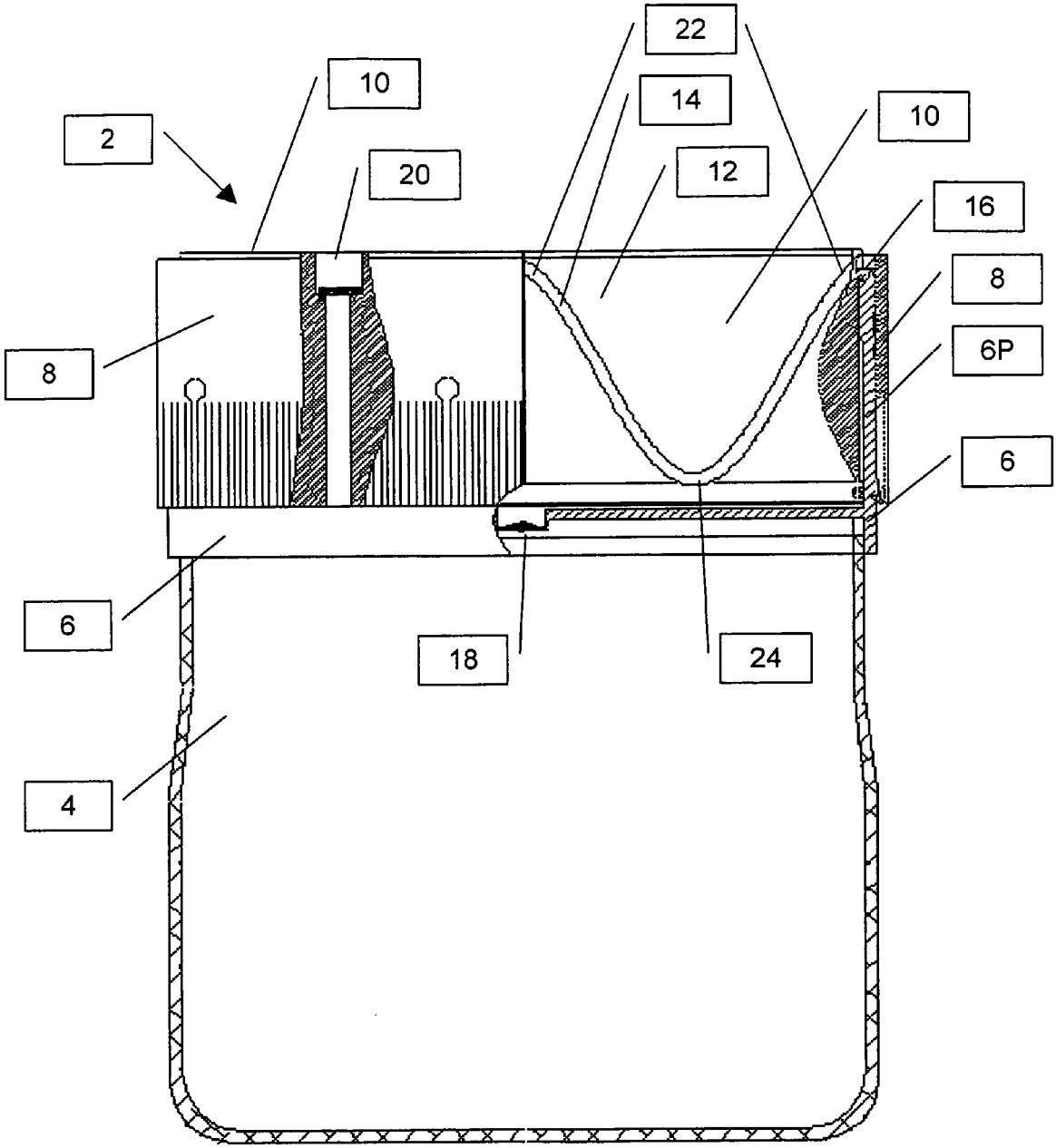
FIG. 1 is a partial cut-away side view of a first preferred embodiment of a lid assembly, constructed and operable according to the teachings of the present invention, deployed on a container.
Figure 4:
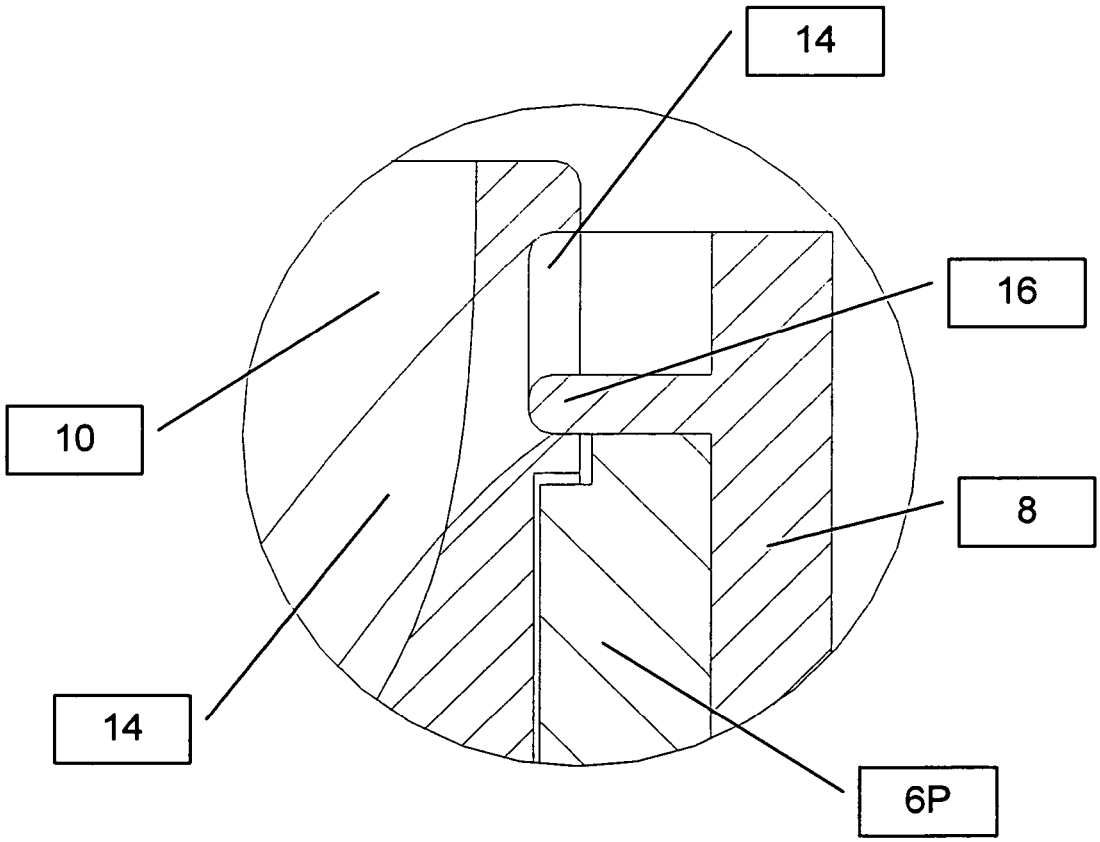
FIG. 4 is a detail of region S of FIG. 2.
Figure 5:
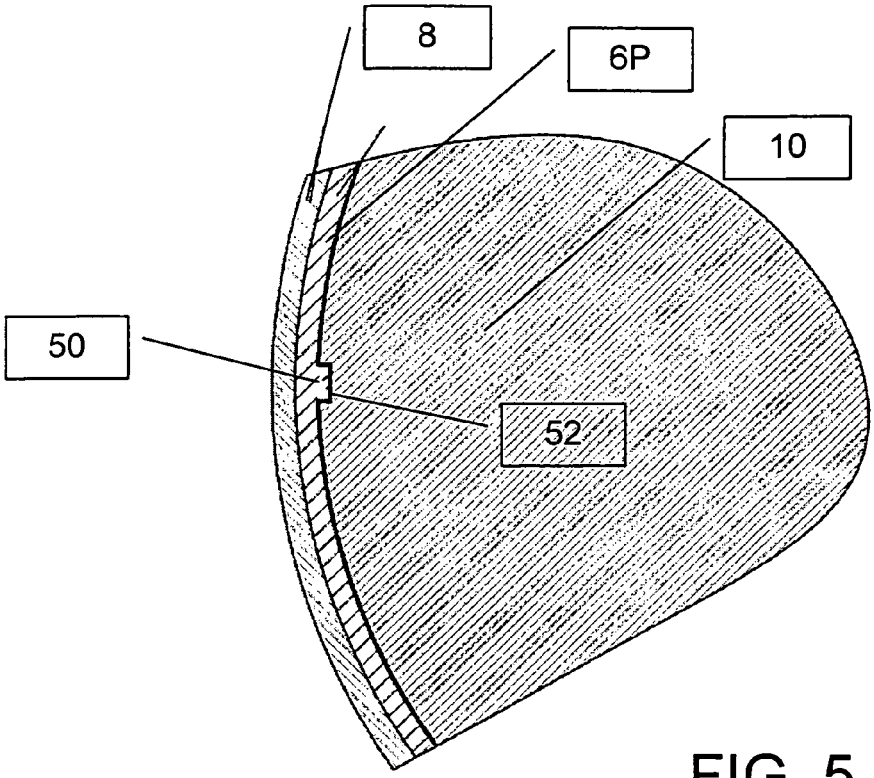
FIG. 5 is a detail of a cross section taken along line B-B of FIG. 2.

Referring now to the drawings, FIG. 1 illustrates basic principles of the pump configuration according to the teachings of the present invention. The first embodiment of a lid assembly 2 is secured on the container 4 by seat-portion 6. A portion of the seat-portion is configured so as to define at least part of a pump cylinder 6P. Circumscribing at least a portion of the pump cylinder 6P is a piston actuating ring 8. A substantially cylindrical pump piston 10 is deployed in the pump cylinder 6P such that a variable pump volume is defined between them. The circumferential wall 12 of the piston is configured with a longitudinally-wave-like groove 14 that circumscribes the piston and joins itself at a point of origin so as to form a single continuous groove. As seen in better detail in FIG. 4, the piston actuating ring 8 is configured with a pump activation pin 16 that extends into the groove 14. As the actuating ring 8 is rotated about the pump cylinder 6P and the piston 10, the pump activating pin 16 contacts the edge of the groove 14. Due to the angle of the groove 14 in relation to the direction of the movement of the pump activating pin 16, the torque of the actuating ring 8 is translated into linear motion of the piston 10. The wave-like configuration of the groove 14, therefore, results in reciprocating linear motion of the piston 10. As the piston 10 moves in a linear direction away from the container 4, the variable pump volume increases in volume and gases are drawn from the interior of the container 4 into the pump through the one-way pump inlet valve 18. It will be appreciated that a configuration in which the wave-like groove is configured in the actuating ring and the pump activating pin configured in the piston is within the spirit of the present invention.

Figure 6:
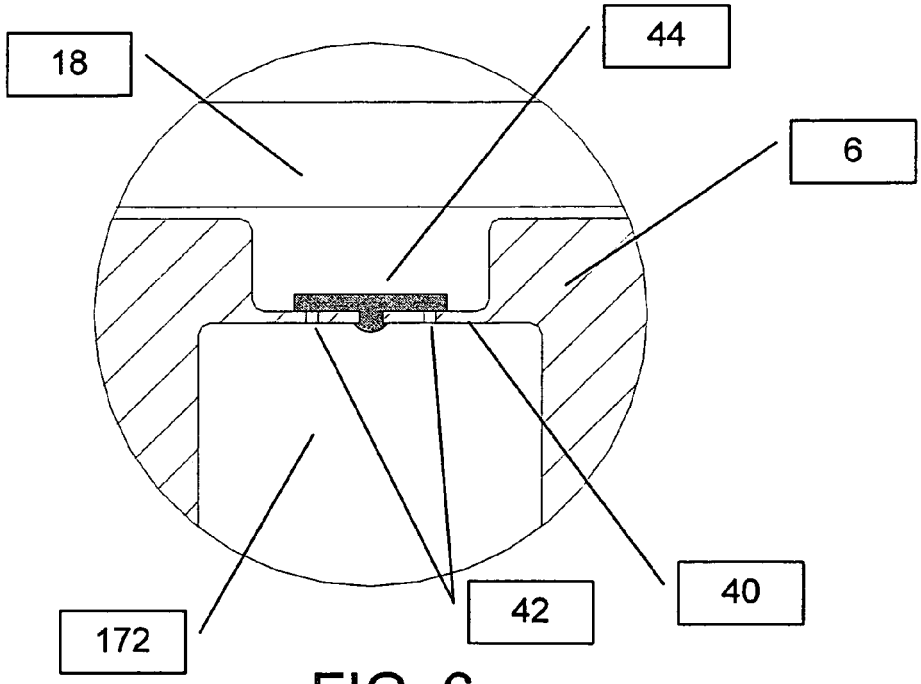
FIG. 6 is a detail of region W of FIG. 2.

As illustrated in FIG. 6, the pump inlet valve 18 may consist of a valve base 40 having at least one passageway 42 through which gases may pass from the interior of the container to the variable pump volume. The passageways 42 are sealed by a resilient sealing element 44. The resilient sealing element 44 is deformable from a normally closed state, in which no gases may pass between the interior of the container and the variable pump volume, and an open state in which gases may pass between the interior of the container and the variable pump volume. Deformation of the resilient sealing element 44 is affected increasing the volume within the variable pump volume such that atmospheric pressure in the variable pump volume is less than the atmospheric pressure within the interior of the container, at which time the pressure of the gases in the container force the deformation of the resilient sealing element 44. As the piston 10 moves in a linear direction toward the container 4, the variable pump volume decreases in volume, pressure in the variable pump volume increases, and gases are forced from the pump to the surrounding atmosphere through the one-way valve 20.

In the preferred embodiments illustrated herein, the groove 14 is configured with four equally spaced apart crests 22 and therefore four equally spaced apart troughs 24, and the actuating ring is configured with four pump activating pins 16, spaced at intervals of 90°. Such a configuration results in four reciprocating linear motions of the piston 10 per one revolution of the actuating ring 8. It will be appreciated that the number of the wave crests 22 and troughs 24 may be varied to suit the circumference of the piston 10. Further, the piston may be actuated by only one or any number of activating pins 16, however, it is preferable that the number of activating pins 16 be equal to the number of wave crests 22.

It will be appreciated that when the actuating ring 8 is rotated, the torque of the actuating ring 8 will cause a rotationally unchecked piston 10 to rotate within the cylinder 6P rather than the desired linear movement. Therefore, in some embodiments, rotation of the piston 10 within the cylinder 6P, when torque is applied by the actuating ring 10, is restricted by a pin 50 extending from the wall of the cylinder 6P, for example, inserted into a groove 52 in the wall of the piston 10, for example. In some alternative embodiments having a central stabilization post 122 (see FIG. 2), rotation of the piston 10 within the cylinder 6P may be restricted by, and pin and groove associated with, the interface of the piston 10 and the central stabilization post 122, or the central stabilization post 122 may be configured with any rotation restricting cross section, such as but not limited to, substantially any closed geometric shape having one or more angles and substantially any smooth closed curve other than a circle.

Figure 3:
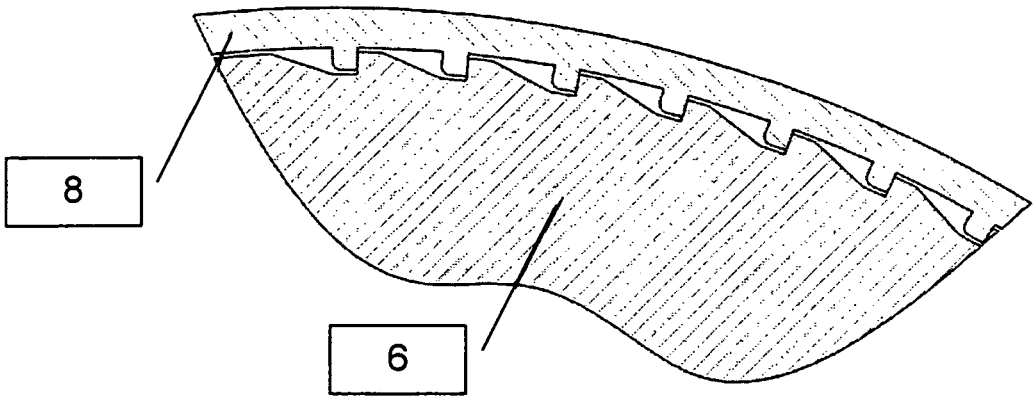
FIG. 3 is a detail of a cross section taken along line C-C of FIG. 2.

Since the actuating ring 8 is free to rotate about the seat-portion 6, in some embodiments of the present invention it is necessary to limit the rotation of the actuating ring 8 to one direction to facilitate screw attachment of the lid assembly 2 to the container 4. FIG. 3 illustrates a first preferred ratcheting configuration that limits rotation of the actuating ring 8 to a counter-clockwise direction in relation to the seat-portion 6 of the lid assembly 2. Once rotation of the actuating ring 8 is thusly limited, the lid assembly 2 is attached to the container 4 by rotating the actuating ring 8, and therefore the seat-portion, in a clockwise direction until a vacuum tight seal is formed between the seat-portion 6 and the container 4. Actuation of the piston 10 in order to create a vacuum state within the container 2 is achieved by rotating the actuating ring 8 in a counter-clockwise direction.

Figure 2:
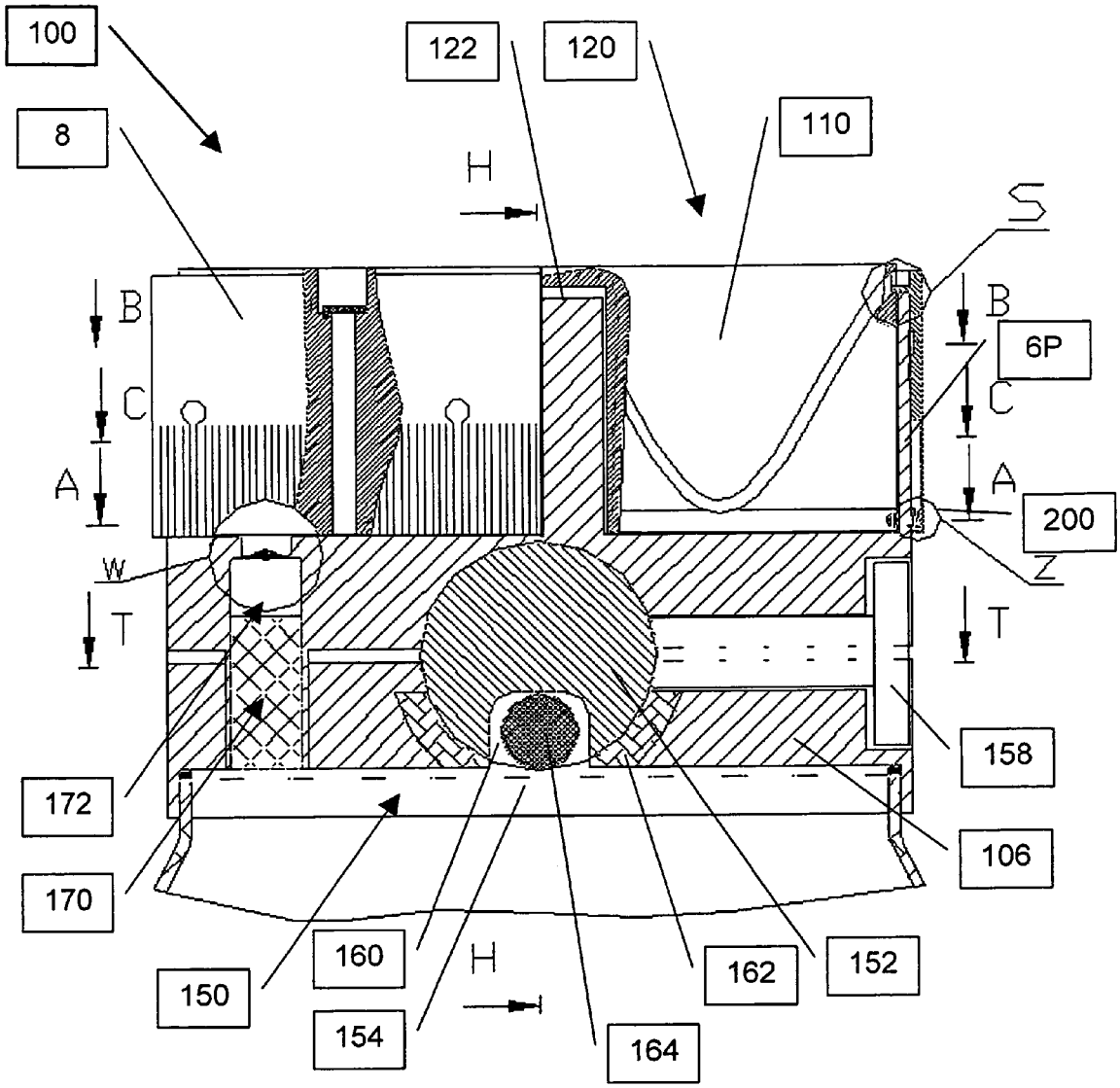
FIG. 2 is a partial cut-away side view of a second preferred embodiment of a lid assembly constructed and operable according to the teachings of the present invention, with a first preferred embodiment of a dispensing mechanism.

FIG. 2 illustrates a second embodiment of a lid assembly 100 configured to include a pump configuration 120, a contents-dispensing mechanism 150, a selectively activated lid-removal mechanism (childproof mechanism) 200, and a filter 170. The pump configuration illustrated here is similar to the pump configuration of FIG. 1, with the addition of a central stabilization post 122 extending from the seat-portion of the lid assembly 100 into the center of the pump cylinder. The piston 10 is configured as an annulus that circumscribes the stabilization post 122 within the pump cylinder.

Figure 7:
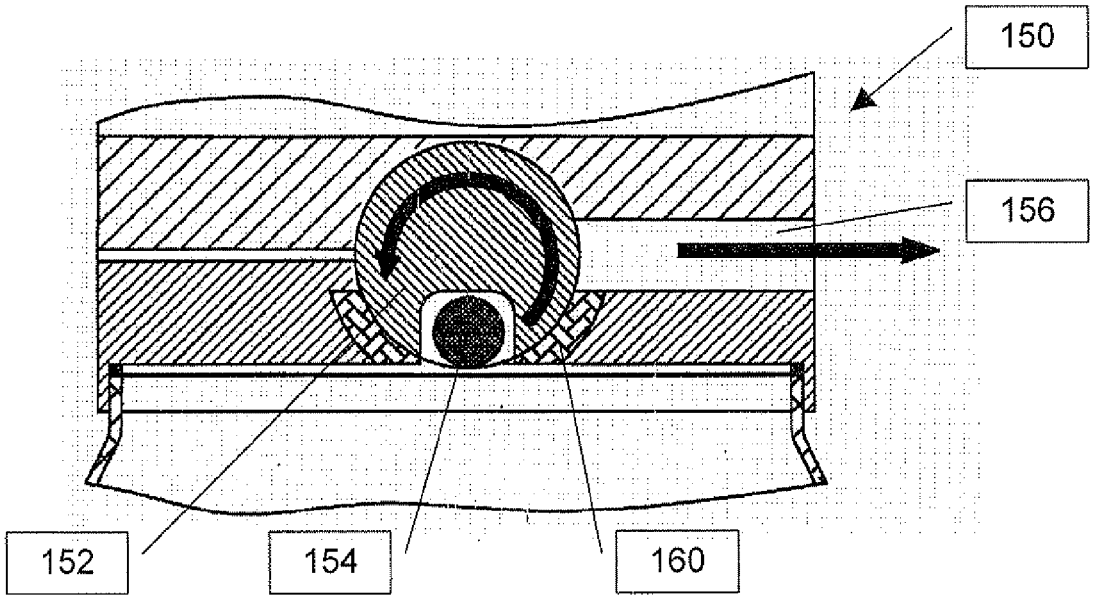
FIG. 7 is a detail of a cross section taken along line H-H of FIG. 2.
Figure 8:
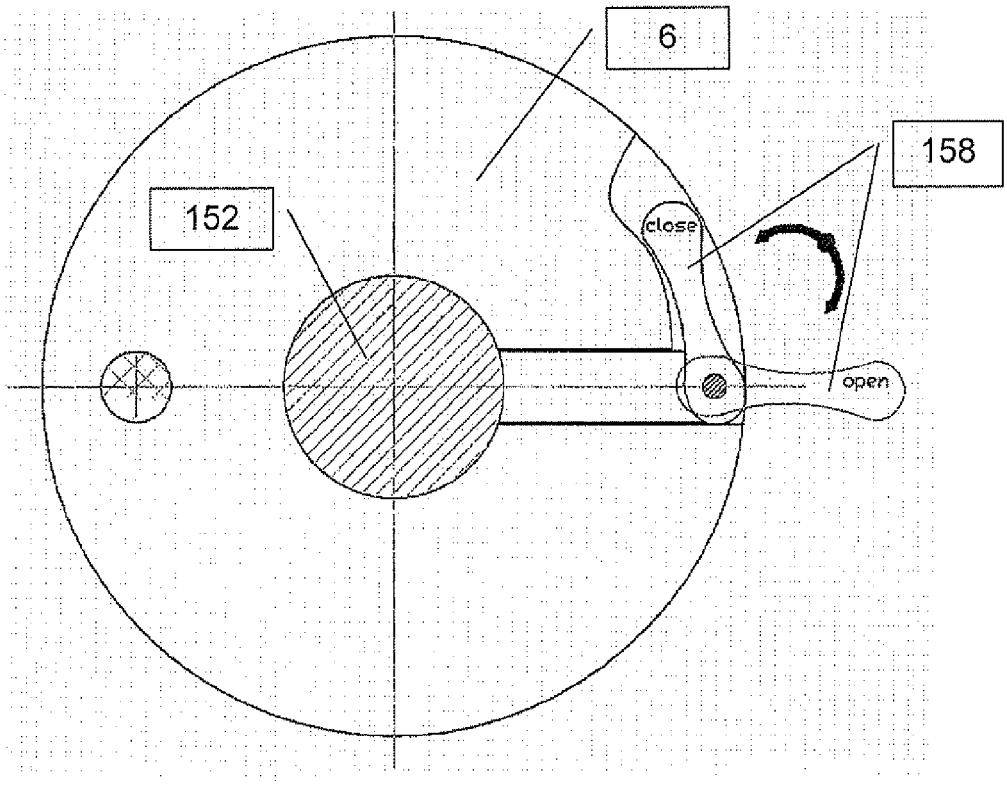
FIG. 8 is a cross section taken along line T-T of FIG. 2.
Figure 9:
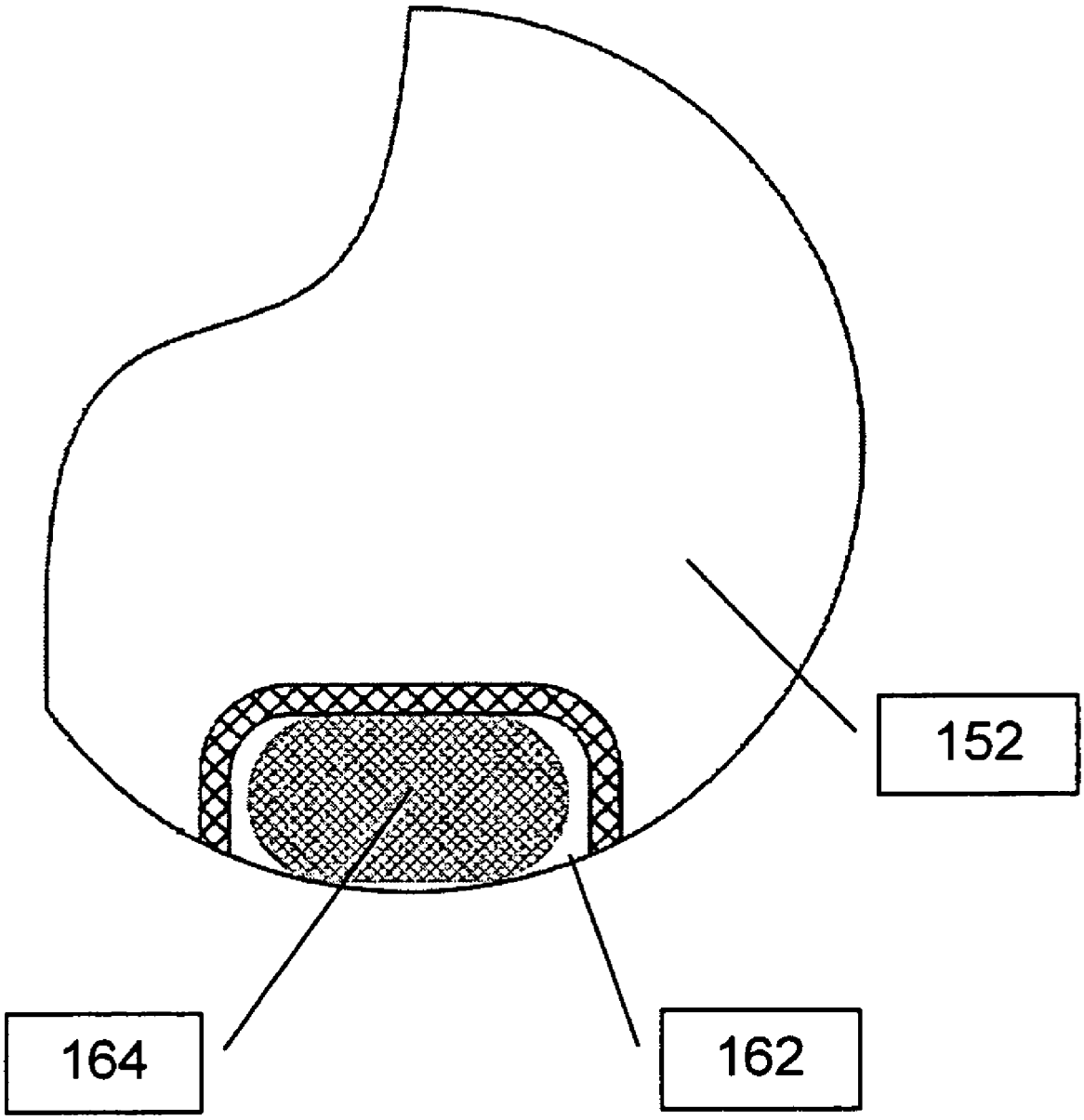
FIG. 9 is a detail showing an alternate contents receptacle constructed and operable according to the teachings of the present invention.

In some applications, once a vacuum is created within the container it is desirable to remove at least some of the contents while maintaining the vacuum state. The present invention therefore provides a contents-dispensing mechanism 150 configured in the seat-portion 106 of the lid assembly 100. The contents-dispensing mechanism 150 includes a rotatable dispensing element 152 that is rotatable such that a contents receptacle 160 travels between a contents inlet 154 and a contents outlet 156 (see FIG. 7). The contents inlet 154 and a contents outlet 156 are spaced apart such that the as the dispensing element is rotated the contents receptacle passes through a region in which fluid communication between the contents receptacle and either the contents inlet or the contents outlet is fully interrupted before fluid communication is established with the other of either the contents inlet or contents outlet. The dispensing element 152 is actuated by the dispensing handle 158, which may be rotated between an open and a closed state (see FIG. 8). It is preferable that the dispensing element 152 be seated in a vacuum seal seat 162 so as to prevent a vacuum leak between the dispensing element 152 and the seat-portion 106 of the lid assembly 100. It should be noted that the dispensing element 152 may be of substantially any suitable shape, such as but not limited to, a sphere (as illustrated herein) and a cylinder. Further, the contents receptacle 160 may be of substantially any suitable size or shape corresponding to the contents 164 of the container, as illustrated in FIG. 9. The contents receptacle 160 may be configured to hold a predetermined number, for example, one, two or more, of individual contents items, such as but not limited to pills and capsules. Alternately, the contents receptacle 160 may be configured to hold a predetermined amount or volume of contents, such as but not limited to, powdered, granulated, and liquid contents. In some embodiments, the dispensing element 152 may be biased to a normal state in which the contents receptacle 160 is aligned with the contents inlet 154. That is, after the contents have been dispensed through the contents outlet 156, the dispensing element 152 will automatically return to a position in which the contents receptacle 160 is in fluid connection with the interior of the container 4.

Figure 10:
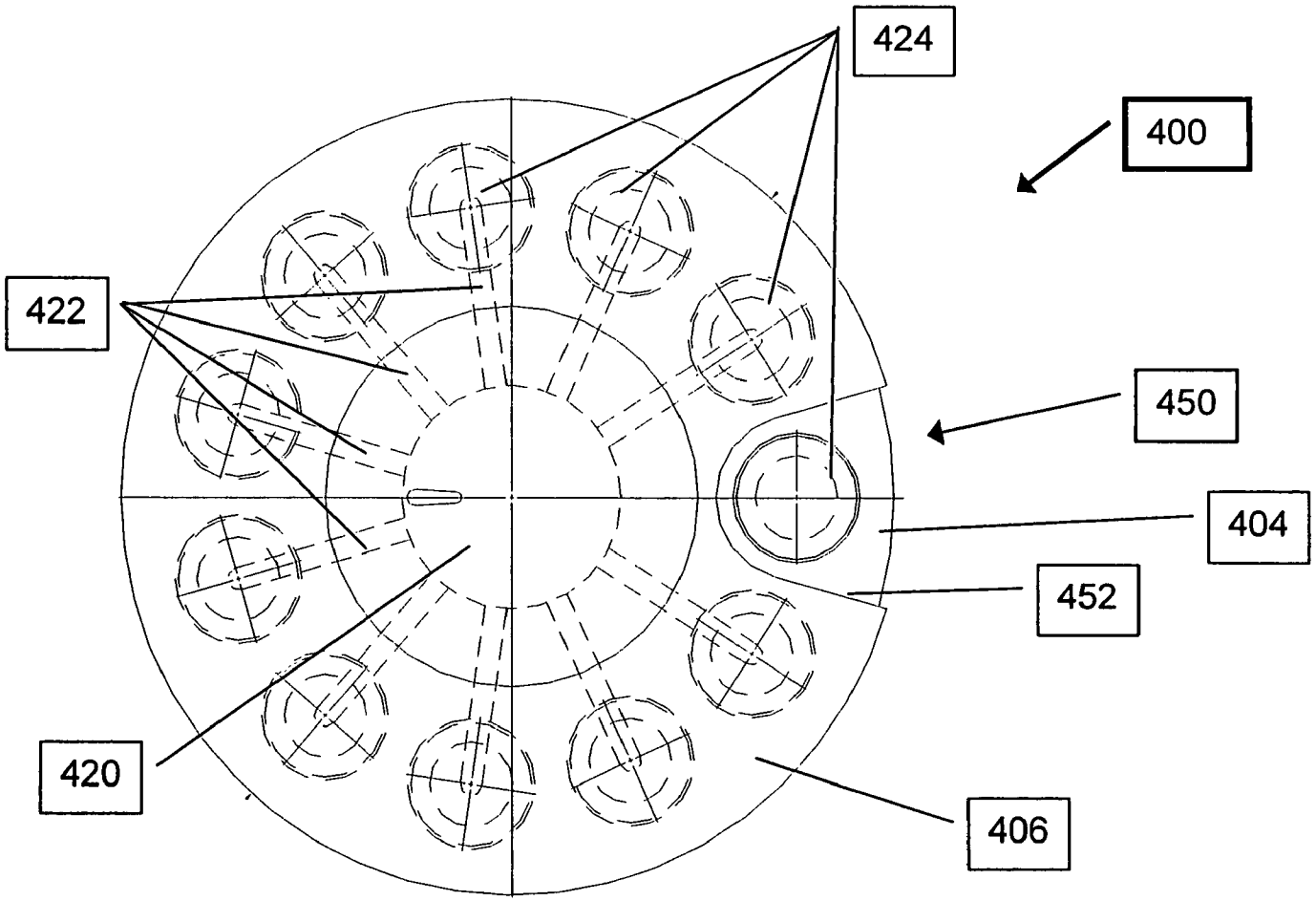
FIG. 10 is a top elevation of a third preferred embodiment of a lid assembly constructed and operative according to the teachings of the present invention, with a second preferred embodiment of a dispensing mechanism.
Figure 11:
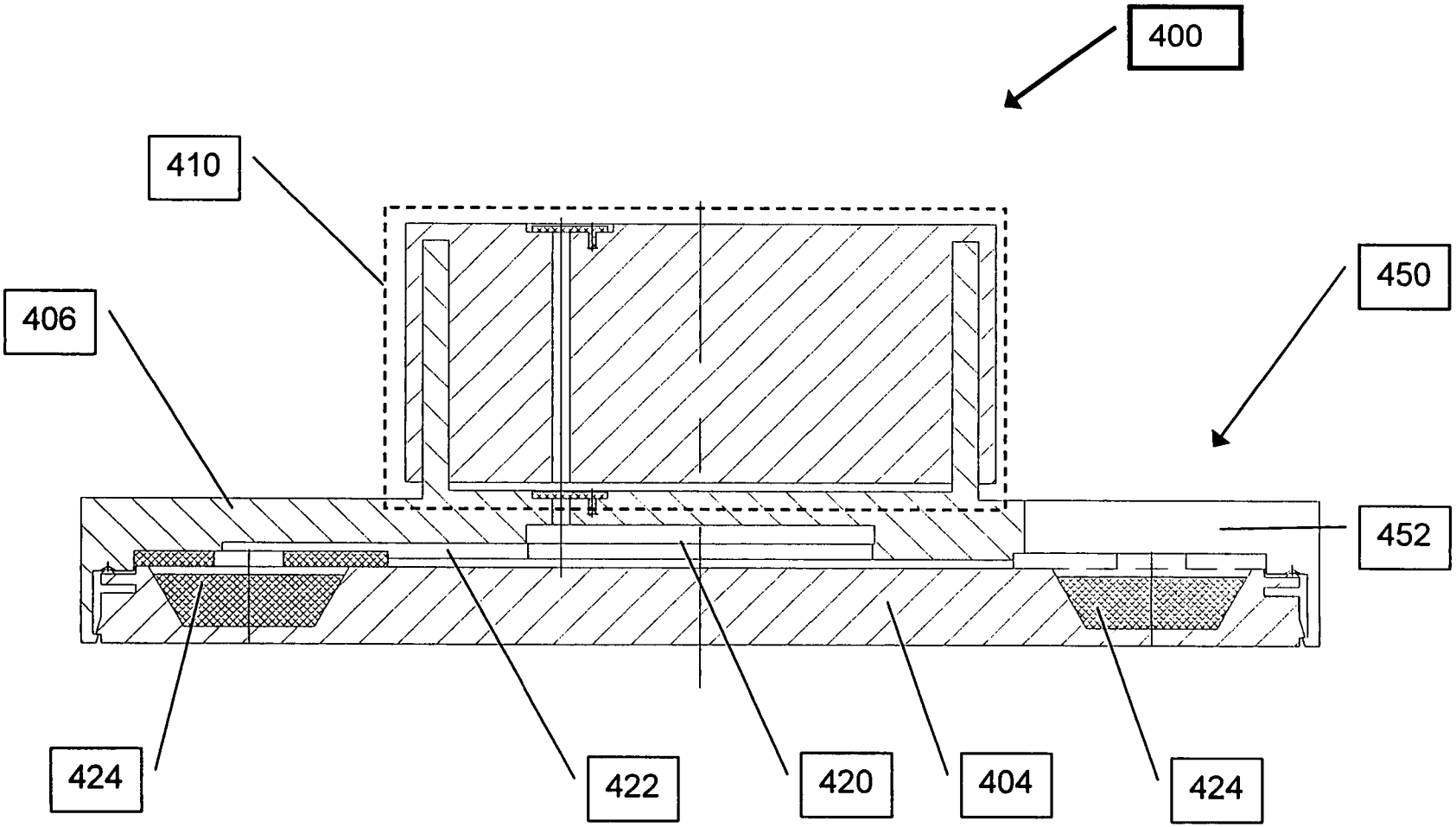
FIG. 11 is a cross section of the embodiment of FIG. 10.

FIGS. 10 and 11 illustrate a third preferred embodiment of a lid assembly 400 having a second preferred embodiment of a contents-dispensing arrangement 450. This embodiment of the present invention includes a seat-portion 406 and a pump configuration 410 substantially as described above with reference to FIG. 1. The contents-dispensing arrangement 450 is configured as a notch 452 in the seat-portion 406 of the lid assembly 400.

The container 404 of this embodiment is configured substantially as a disk having a plurality of individual storage compartments 424. The container 404 is rotatably attached to the seat-portion 406 so as to rotate about an axis that is substantially perpendicular to the plane of the interface between the container 404 and the seat-portion 406. Preferably, the individual storage compartments 424 are configured to store a single prescribed amount of the substance stored therein. Each of the individual storage compartments 424 is in fluid communication with the pump configuration 410 by a vacuum passageway 422 that extends form the central vacuum chamber 420. Preferably, the vacuum passageways 422 and the central vacuum chamber 420 are configured in the underside of the seat-portion 406. Alternately, these elements may be configured in the container 404. It will appreciated that an embodiment in which the individual vacuum passageways 422 are in direct fluid communication with the pump configuration 410 is with in the scope of the present invention.

A vacuum state is created in the individual storage compartments 424 when the pump configuration 410 is activated and air is pumped out of the central vacuum chamber 420, and thereby, out of the vacuum passageways 422 and individual storage compartments 424 as well.

Introduction of contents into the individual storage compartments 424 may be accomplished by placing the desired amount of contents into an individual storage compartment 424, then rotating the container 404 so as to expose the next adjacent individual storage compartment 424. Once the desired number of individual storage compartments 424 contain contents for storage, a vacuum state is created within the individual storage compartments 424, by activating the pump configuration 410.

Removal of the contents from one of the individual storage compartments 424 is achieved by rotating the container 404 so as to expose the next adjacent individual storage compartment 424 containing contents, and removing the contents from the now exposed individual storage compartment 424. It will be appreciated that any loss of vacuum due to the dispensing action may be compensated for by activating the pump arrangement 410.

It should be noted that within the scope to the present invention, substantially any pump mechanism may be used in conjunction with the dispensing mechanisms of the present invention with equal expectation of success, therefore, the pump configurations described herein are considered to be examples rather than limitation of the present invention.

It will be appreciated that the above descriptions are intended only to serve as examples and that many other embodiments are possible within the spirit and the scope of the present invention.

What is claimed is:

1. A lid assembly for removing contents from a container in which at least a partial vacuum state has been created while maintaining the vacuum state in the container, the lid assembly comprising:

(a) a seat-portion configured for attaching the lid assembly to the container;

(b) a pump mechanism for creating the vacuum state within the container, said pump mechanism including:

(i) a pump configuration associated with said seat-portion and configured with a pumping element actuated in a reciprocating linear motion to pump gas from within the container to an external atmosphere; and (ii) a rotatable actuating element mechanically associated with said pump configuration, and said actuating element substantially circumscribes at least a portion of said pump configuration, such that continuous rotation of said actuating element about said pump configuration in a given rotational direction generates said reciprocating linear motion of said pumping element, thereby expelling a quantity of gas from the container to generate the at least a partial vacuum;

wherein one of said pumping element and said actuating element includes a longitudinally-wave-like groove, and the other of said pumping element and said actuating element includes at least one pump activation pin configured to engage said wave-like groove, such that during said continuous rotation said activation pin contacts an edge of said longitudinally-wave-like groove, thereby generating said reciprocating linear motion.;

(c) a contents inlet configured in said seat-portion, said contents inlet opening into an interior volume of the container;

(d) a contents outlet configured in said seat-portion, said contents outlet opening to an exterior atmosphere of the container;

(e) a rotatable dispensing element deployed in said seat-portion, said rotatable dispensing element seated in a vacuum seal seat so as to prevent a vacuum leak between said dispensing element and said seat-portion, and said rotatable dispensing element is actuated by a rotatable shaft manipulated from an exterior of said seat-portion; and (f) a contents receptacle configured in said dispensing element, said dispensing element rotatable such that said contents receptacle is alternately alignable with said contents inlet and said contents outlet;

wherein said contents inlet and said contents outlet are spaced apart such that as said contents receptacle alternates between said contents inlet and said contents outlet said contents receptacle passes through a region in which fluid communication between said contents receptacle and one of said contents inlet and said contents outlet is fully interrupted before fluid communication is established with another of contents inlet and said contents outlet.

2. A lid assembly for removing contents from a container in which at least a partial vacuum state has been created while maintaining the vacuum state in the container, the lid assembly comprising:

(a) a seat-portion configured for attaching the lid assembly to the container;

(b) a pump mechanism for creating the vacuum state within the container, said pump mechanism including:

(i) a pump configuration associated with said seat-portion and configured with a pumping element actuated in a reciprocating linear motion to pump gas from within the container to an external atmosphere; and (ii) a rotatable actuating element mechanically associated with said pump configuration, and said actuating element substantially circumscribes at least a portion of said pump configuration, such that continuous rotation of said actuating element about said pump configuration in a given rotational direction generates said reciprocating linear motion of said pumping element, thereby expelling a quantity of gas from the container to generate the at least a partial vacuum;

wherein one of said pumping element at said actuating element includes a longitudinally-wave-like groove, and the other of said pumping element and said actuating element includes at least one pump activation pin configured to engage said wave-like groove, such that during said continuous rotation said activation pin contacts an edge of said longitudinally-wave-like groove, thereby generating said reciprocating linear motiom;

(c) a contents inlet configured in said seat-portion, said contents inlet opening into an interior volume of the container;

(d) a contents outlet configured in said seat-portion, said contents outlet opening to an exterior atmosphere of the container;

(e) a rotatable dispensing element deployed in said seat-portion, said rotatable dispensing element configured as a substantially spherical element seated in a vacuum seal seat so as to prevent a vacuum leak between said dispensing element and said seat-portion; and (f) a contents receptacle configured in said dispensing element, said dispensing element rotatable such that said contents receptacle is alternately alignable with said contents inlet and said contents outlet;

wherein said contents inlet and said contents outlet are spaced apart such that as said contents receptacle alternates between said contents inlet and said contents outlet said contents receptacle passes through a region in which fluid communication between said contents receptacle and one of said contents inlet and said contents outlet is fully interrupted before fluid communication is established with another of contents inlet and said contents outlet.

* * * * *